US005975211A

United States Patent [19]

Harris

[11] Patent Number: 5,975,211

[45] Date of Patent: Nov. 2, 1999

[54] WELLHEAD BORE ISOLATION TOOL

[76] Inventor: Monty E. Harris, 501 Twilla Trail, Azle, Tex. 76020

[21] Appl. No.: 09/012,020

[22] Filed: Jan. 22, 1998

[51] Int. Cl.[6] ..... E21B 23/00; E21B 33/068

[52] U.S. Cl. ..... 166/379; 166/90.1; 166/383

[58] Field of Search ..... 166/379, 383, 166/80.1, 90.1, 77.4

[56] References Cited

U.S. PATENT DOCUMENTS

| | | | |
|---|---|---|---|
| 2,758,654 | 8/1956 | Simmons | 166/77.4 |
| 3,830,304 | 8/1974 | Cummins | 166/305 R |
| 4,023,814 | 5/1977 | Pitts | 277/328 |
| 4,111,261 | 9/1978 | Oliver | 166/86 |
| 4,691,770 | 9/1987 | McLeod | 166/73 |
| 4,991,650 | 2/1991 | McLeod | 166/72 |
| 4,993,488 | 2/1991 | McLeod | 166/72 |
| 4,993,489 | 2/1991 | McLeod | 166/72 |
| 5,012,865 | 5/1991 | McLeod | 166/91 |
| 5,020,590 | 6/1991 | McLeod | 166/77.4 |
| 5,025,875 | 6/1991 | McLeod | 166/77.4 |
| 5,285,852 | 2/1994 | McLeod | 166/379 |
| 5,332,044 | 7/1994 | Dallas et al. | 166/386 |
| 5,372,202 | 12/1994 | Dallas | 166/386 |
| 5,819,851 | 10/1998 | Dallas | 166/308 |

OTHER PUBLICATIONS

Model "A" Wellhead Protector Tool brochure; Western Petroleum Service; Nov. 1986.

*Primary Examiner*—Hoang C. Dang
*Attorney, Agent, or Firm*—James E. Bradley

[57] ABSTRACT

A wellhead isolation tool is mounted to a wellhead to isolate the bore of the wellhead from a treating fluid being injected. The isolation tool has a housing which has an upper section and a lower section. A valve is connected between the upper and lower sections. A mandrel is slidably carried in the housing and moves from an upper position spaced entirely in the housing to a lower position extending through the bore of the wellhead. In the lower position, the upper end of the mandrel is below the valve. This allows the valve to be closed and the upper section removed. The treating line is attached to the upper end of the valve. The nozzle has annular recesses formed in it to enhance turbulence to reduce erosion.

18 Claims, 4 Drawing Sheets

WELLHEAD BORE ISOLATION TOOL

TECHNICAL FIELD

This invention deals with an apparatus designed to isolate the bores of wellhead equipment from pressurized well treating fluids being injected into the well.

BACKGROUND ART

A producing well will have a wellhead or Christmas tree at the surface for controlling the well. The wellhead assembly supports casing which extends into the well. Tubing extends through the casing for producing the formation fluids. The Christmas tree is a tubular body having a bore extending vertically through it with outlets leading from the bore through the sidewall. Valves are mounted in the bore and to the outlets of the tree for providing access to the tubing as well as directing the produced fluid out to a flow line.

From time to time, many wells require the injection of a treating fluid. One technique know as fracing involves pumping high pressure fluid into the well to fracture the formation to enhance its production. Small hard spheres called proppants are contained in the slurry being pumped into the well. Other techniques involve pumping corrosive fluids such as acid into the well to enhance formation fluid production.

During the well treatment process, lines from large pumps will be connected to the wellhead to pump the treatment fluid through the wellhead and down the tubing. The treatment fluid can be damaging to the interior of the bore of the wellhead. Acids may be corrosive, and slurries with proppants can cause erosion of the wellhead bore. To avoid damage, isolation tools have been used to isolate the bore of the wellhead. A typical isolation tool has a lubricator housing that mounts to the upper end of the wellhead. A tubular mandrel with a piston is located in the housing. After the housing is installed on the wellhead, the operator opens the wellhead master valve and applies hydraulic pressure to the piston to force the mandrel downward. The lower end of the mandrel will extend through the bore of the wellhead and sealingly into the tubing. A treatment line is connected to the upper end of the lubricator housing for delivering the fluid through the mandrel and into the tubing.

While workable, one disadvantage is that the upper end of the lubricator housing can be quite high because the housing has to be at least as long as the mandrel. The mandrel has to be long enough to extend completely through the wellhead into the tubing. Connecting the treatment line to the top of the housing is difficult.

Also, the nozzles located at the lower ends of prior art isolation tools do not adequately protect the production tubing from excessive wear. With high flow rates, the nozzles direct the fluid outward at high velocities which can wear the inside of the tubing, particularly if the injection fluid has solids contained therein.

SUMMARY OF THE INVENTION

In this invention, the lubricator housing is in two sections, having an upper section which is removable from a lower section. A tubular mandrel locates within an axial passage in the housing and is moveable from an upper position to a lower position extending through the wellhead into the production tubing. A valve is located between the upper and lower sections. In the lower position, the mandrel upper end will be below the valve. This position allows the operator to close the valve and remove the upper section. The treatment line is connected to the upper end of the lower section.

The mandrel is stroked from the upper to the lower position by using a pressure differential between wellhead pressure and a hydraulic pump pressure. A piston is located at the upper end of the mandrel. A stationary seal is mounted in the housing and slidingly engages the mandrel. This creates an annular space between the piston and the seal. An injection port allows hydraulic fluid to be injected into the annular space to urge the mandrel upward. The operator applies hydraulic fluid pressure at a level that is in excess of the wellhead pressure. Opening the wellhead master valve then communicates wellhead pressure to the upper end of the piston on the mandrel. Then, reducing the hydraulic fluid pressure will allow the wellhead pressure to push the mandrel downward at a desired rate until the mandrel reaches the lower position.

A nozzle is located at the lower end of the mandrel. The nozzle has annular internal recesses. The recesses create turbulence that reduce the velocity of the flowing fluid.

BEST MODE FOR CARRYING OUT THE INVENTION

Figure 1A:
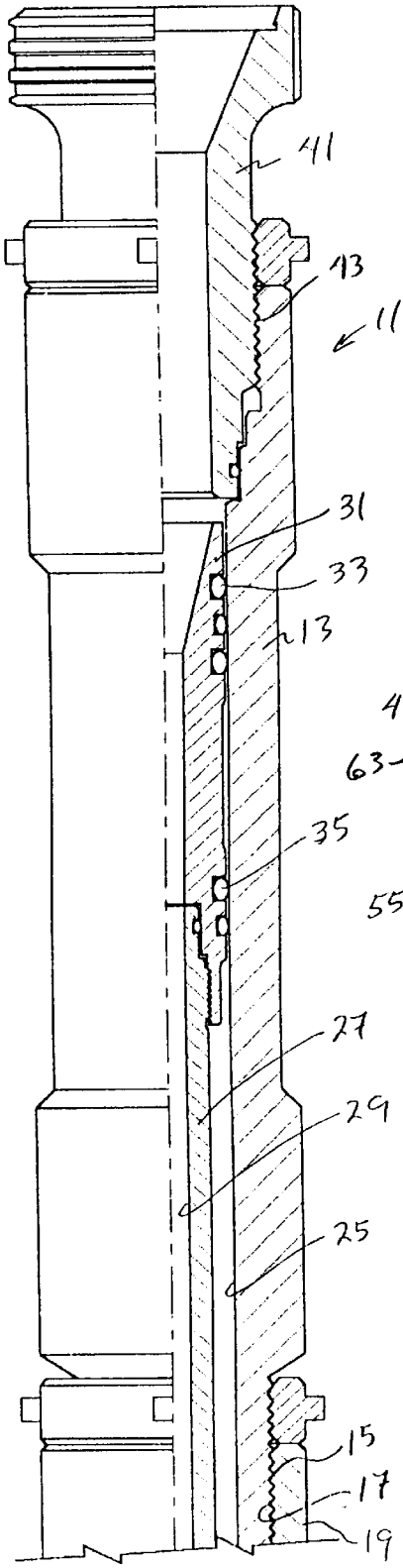
FIGS. 1A, 1B and 1C comprise a vertical sectional view of an isolation tool constructed in accordance with this invention, with the mandrel shown in the upper position.
Figure 1B:
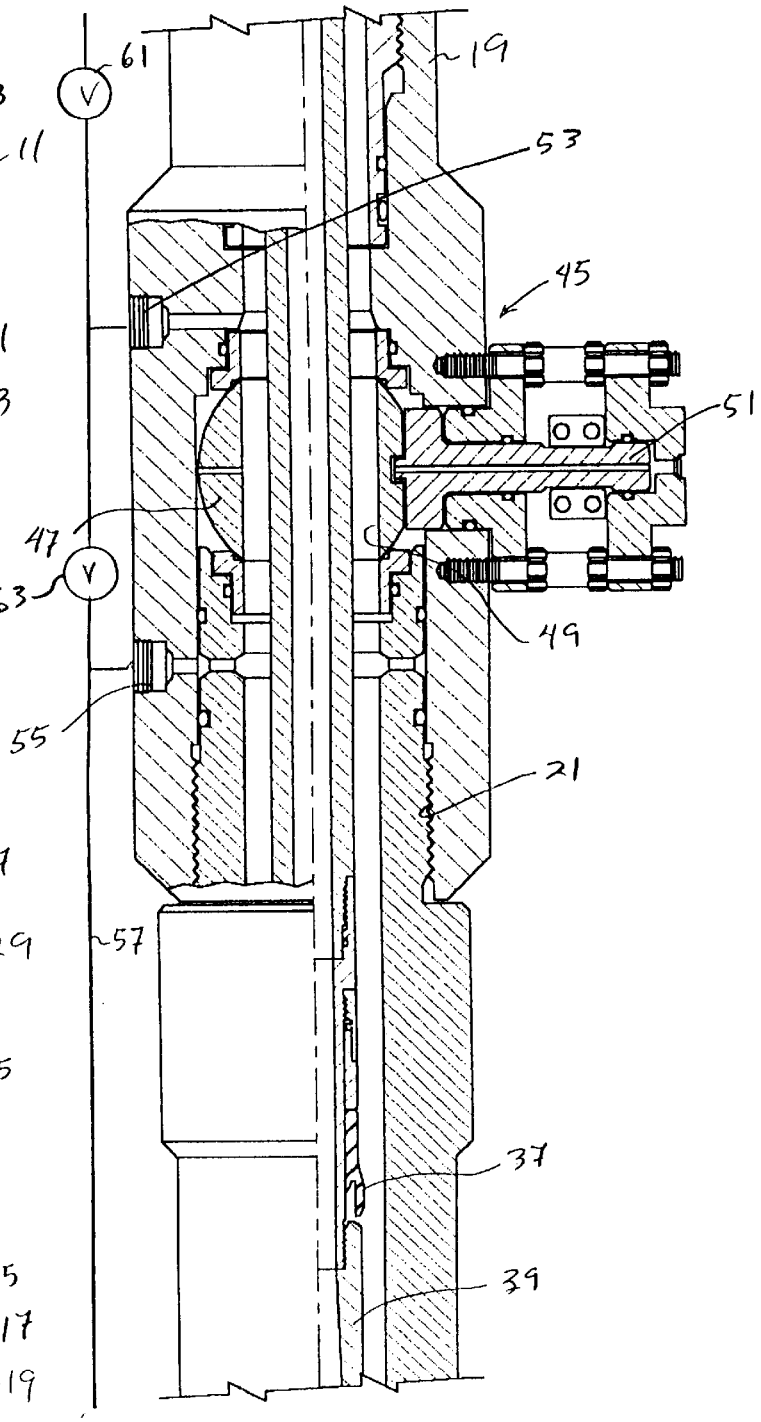

Referring to FIG. 1A, isolation tool 11 has a housing upper section 13. Upper section 13 is a tubular member having a threaded lower end 15. Lower end 15 engages a threaded upper end 17 of a tubular valve body 19. As shown in FIG. 1B, valve body 19 has threads 21 on its lower end which secure to a tubular housing lower section 23. For the purposes herein, valve body 19 may be considered as part of housing lower section 23.

An axial passage 25 extends through upper section 13, valve body 19 and lower section 23. A mandrel 27 is carried in passage 25 and is shown in an upper position in FIGS. 1A–1C. FIGS. 2A–2C show mandrel 27 in a lower position. Mandrel 27 has an axial passage 29 extending through it. A piston 31 is mounted to and forms the upper end of mandrel 27. Piston 31 has axially spaced apart seals 33, 35 which slidingly and sealingly engage passage 25. Mandrel 27 has a lower seal or packoff 37 (FIG. 1B) located near a nozzle 39 at the lower end. Packoff 37 is an elastomeric lip seal, having a lip that extends downward and is radially deformable. The lip of packoff 37 has a slightly larger outer diameter in the undeformed condition than mandrel 27.

Referring to FIG. 1A, an adapter 41 mounts to the upper end of upper section 13 by threads 43. A plug valve (not shown) will initially be connected to adapter 41 for closing the upper end of housing passage 25.

Referring to FIG. 1B, valve body 19 is part of a valve 45 that will selectively open and close housing passage 25. In the embodiment shown, valve 45 is a ball valve, having a ball element 47 which has a valve passage 49. Rotating ball 47 ninety degrees will orient passage 49 from the open position shown to a closed position perpendicular to passage 25 to block flow. An actuator 51 is employed to rotate valve ball 47.

An upper port 53 extends from passage 25 to the exterior of valve body 19 above ball 47. An intermediate port 55 extends through valve body 19 below ball 47 to the exterior of valve body 19. Ports 53, 55 are connected to each other by a line 57. Line 57 extends to a port 59 (FIG. 1C) located near the lower end of housing lower section 23. Lower port 59 leads to housing passage 25. Referring again to FIG. 1B, a bleed-off valve 61 is connected to upper port 53 for bleeding off pressure in housing passage 25 above ball valve 45 when valve 45 is closed. A port valve 63 is connected into line 57 between ports 53 and 55. Similarly, a port valve 65 is located in line 57 between ports 55 and 59.

A seat 64, which is a sleeve, is secured stationarily in housing passage 25 at the lower end. Port 59 extends radially through seat 64 into passage 25. Stationary seals 67 are mounted in the inner diameter of seat 64. Seals 67 seal to nozzle 39 while mandrel 27 is in the upper position. Seals 67 engage the outer diameter of mandrel 27 while mandrel 27 is moving to and in the lower position. Seals 67 on the lower end and seals 35 on piston 31 (FIG. 1A) define an annular chamber 70 surrounding mandrel 27. A hydraulic fluid injection port 66 extends through housing lower section 23 above seat 64 for applying hydraulic fluid pressure to annular chamber 70. Hydraulic fluid injection port 66 is connected to a hydraulic pressure source or pump 68. Tool 11 mounts to the upper end of a wellhead or production tree assembly 71, shown schematically in FIG. 1C. Wellhead 71 has a bore 73 that extends axially through it. A master valve 75 when closed will close bore 73. A string of tubing 77 extends from wellhead 71 below master valve 75 into the well. A wing valve 79 is mounted to a port 80 that extends through the side of wellhead 71 above the upper end of tubing 77. During production, master valve 75 is closed and wing valve 79 open, allowing production fluids to flow from tubing 77 and out through wing valve 79.

Figure 3:
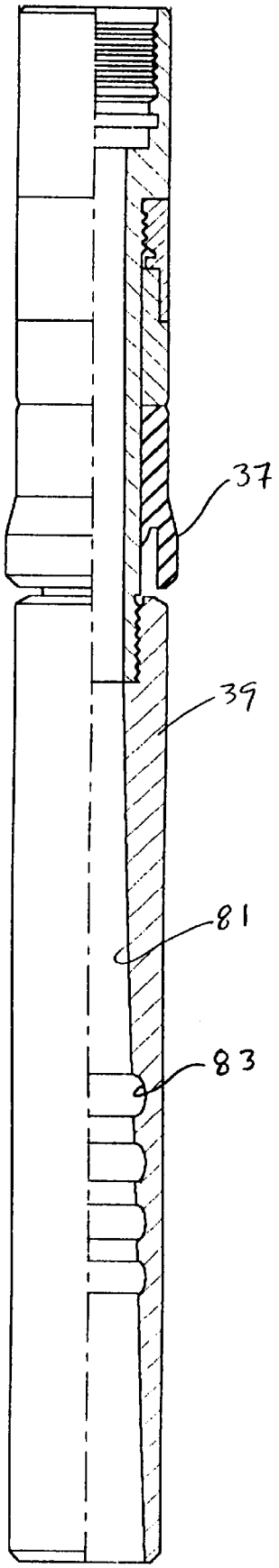
FIG. 3 is an enlarged sectional view of the nozzle and lower end of the mandrel of the isolation tool of FIGS. 1A–1C.

Referring to FIG. 3, nozzle 39 has a diverging passage 81 through which fluid is discharged. A set of recesses 83 are located in passage 81 between the upper and lower ends of nozzle 39. Each recess 83 is an annular groove having a curved cross-section as shown in FIG. 3. Recesses 83 are spaced about the same distance apart. Preferably, the diameter of each recess 83 is slightly larger than the recess 83 directly above. The difference in diameter is at the same rate of taper as passage 81. Each groove 83 thus has the same depth within diverging passage 81. Grooves 83 function to create turbulent flow near the inside of passage 83.

Figure 1C:
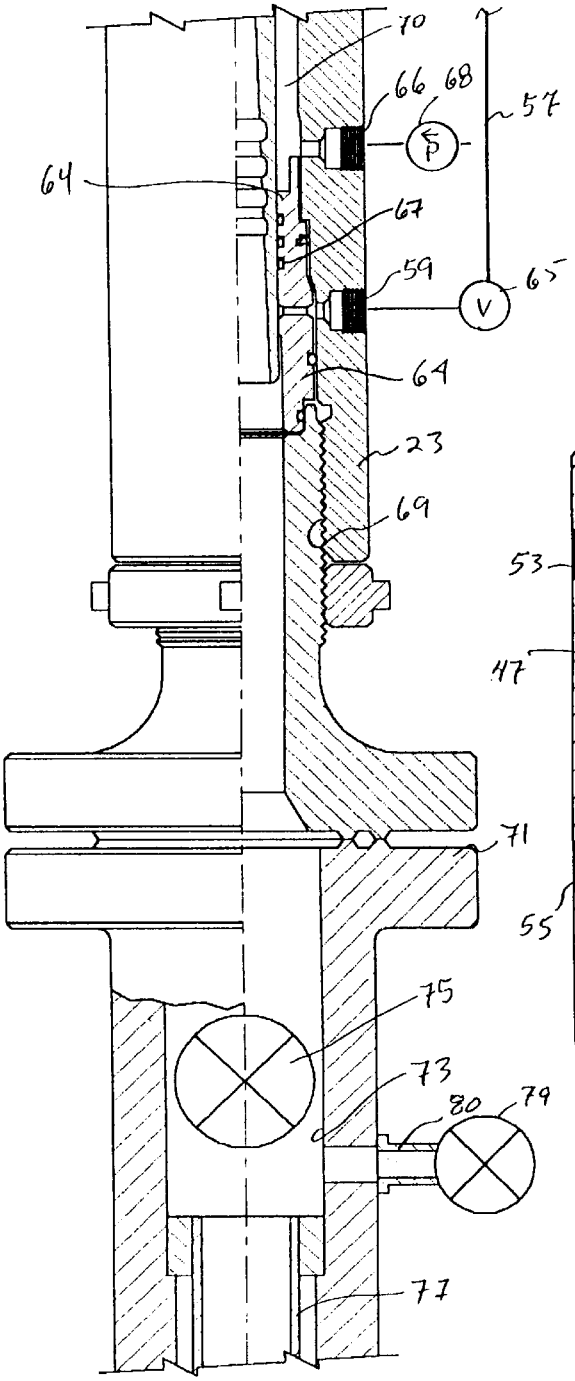
Figure 2A:
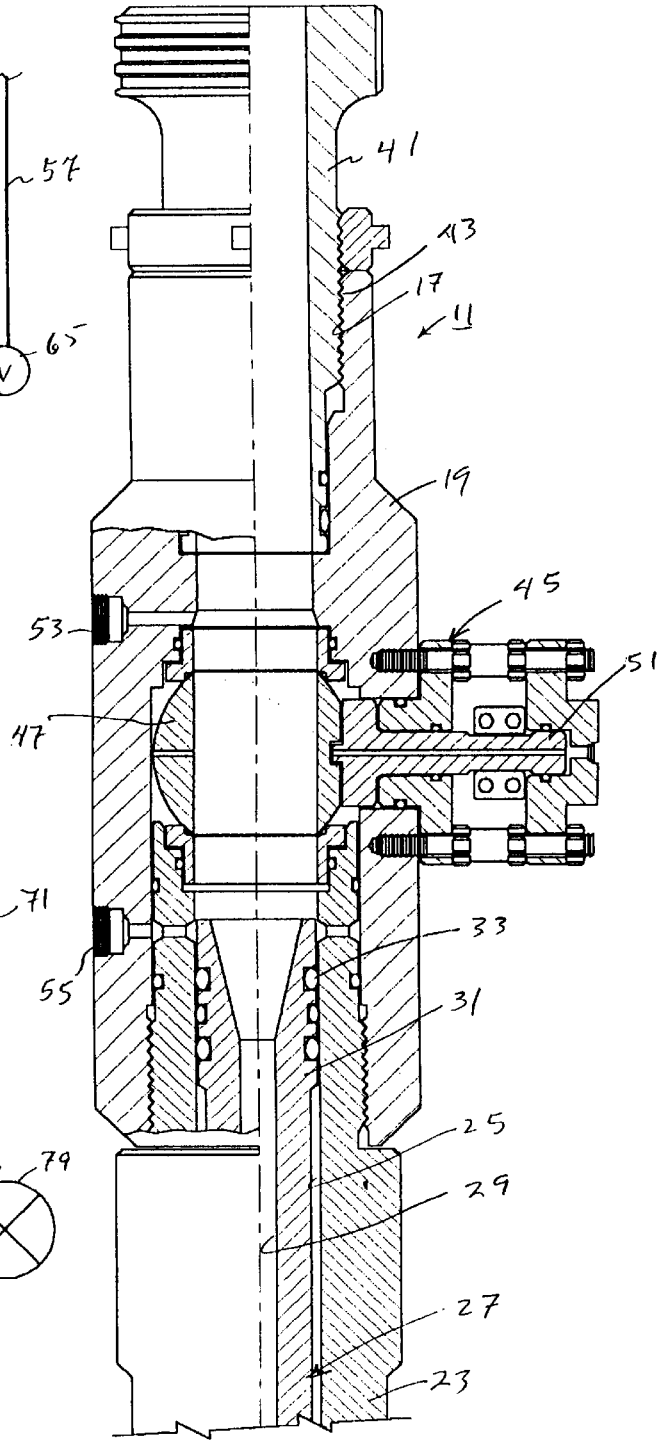
FIGS. 2A, 2B and 2C comprise a sectional view of the isolation tool of FIGS. 1A–1C, with the upper section shown removed and the mandrel in a lower position.
Figure 2B:
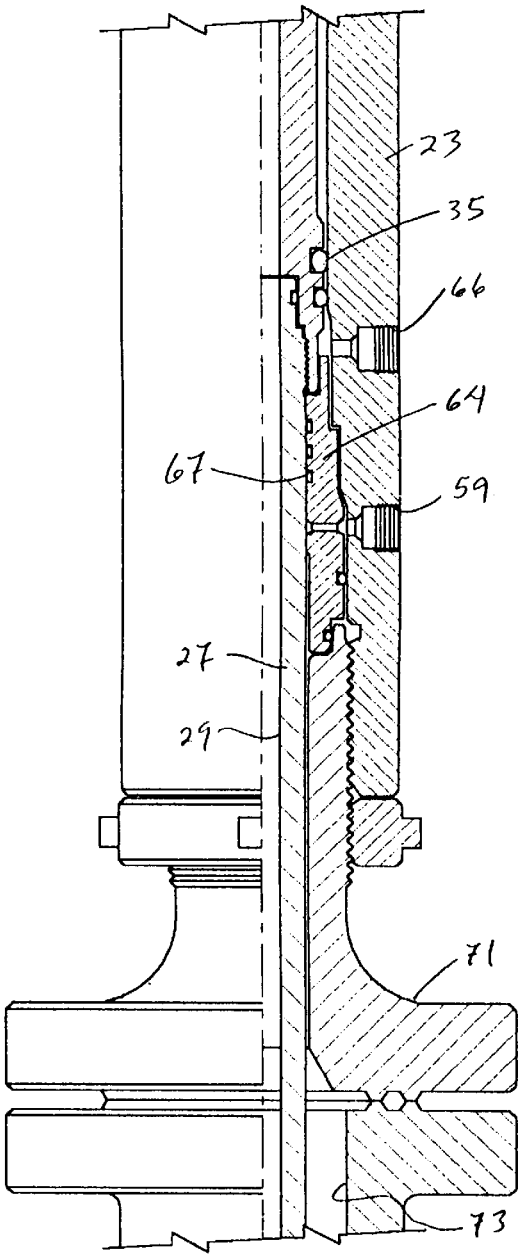
Figure 2C:
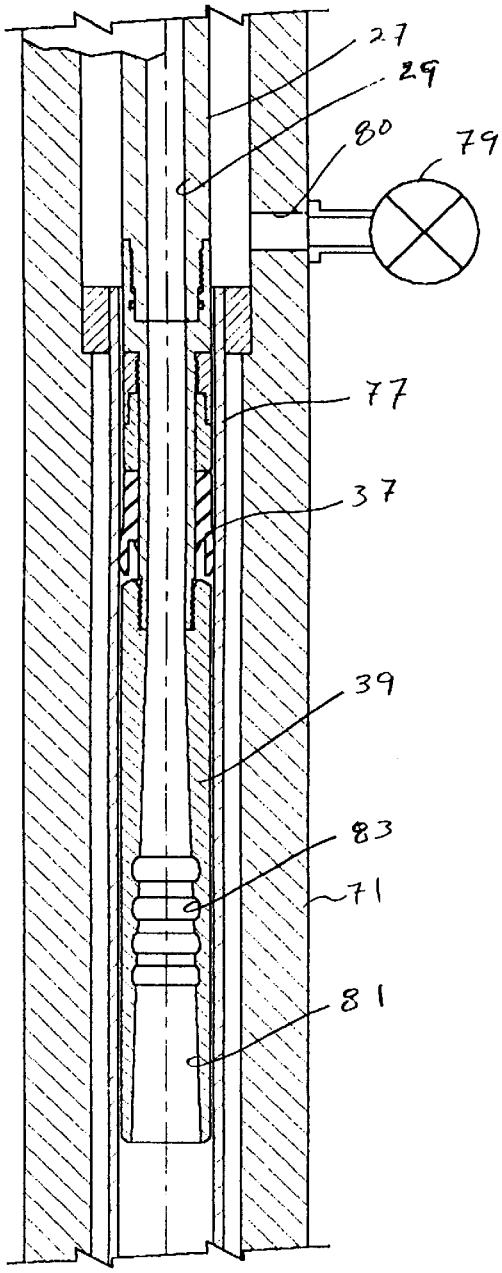

In operation, normally the well will be a producing well with formation pressure in tubing 77 and in bore 73 of wellhead 71 (FIG. 1C). Prior to installing isolation tool 11, the operator will close wing valve 79 and master valve 75. The operator assembles tool 11 with mandrel 27 in the upper position and ball valve 45 located between upper section 13 and lower section 23. Valve 45 will be in the open position because mandrel 27 extends into lower section 23 with nozzle 39 being sealingly engaged by seal 67 as shown in FIG. 1C. A plug valve will be connected to adapter 41 and closed. Initially, there will be no pressure within housing sections 13, 23 because master valve 75 will be closed. Port valves 63 and 65 are open, connecting ports 53, 55 with port 65. Bleedoff valve 61 (FIG. 1B) will be closed.

Hydraulic pressure is supplied through port 66 from pump 68 at a level that is approximately 500 psi greater than the wellhead pressure in bore 73. The hydraulic fluid pressure pressurizes annular chamber 70, urging piston 31 (FIG. 1A) upward. Master valve 75 is then opened slowly. This allows well pressure to enter mandrel passage 29. This pressure acts on the upper end of piston 31, creating a downward force in opposition to the upward force due to hydraulic fluid pressure in annular chamber 70. The downward force will initially not be as great as the upward force because the hydraulic fluid in chamber 70 is at a greater pressure. The operator now gradually reduces the hydraulic pressure at port 66, lowering the upward force on piston 31. The pressure differential on piston 31 will shift to a net downward force, causing mandrel 27 to move downward until piston 31 contacts an upper edge of seat 64 as shown in FIG. 2B. Mandrel 27 will extend through bore 73 and into production tubing 77 as shown in FIG. 2C. Packoff 37 will sealingly engage the interior of tubing 77. Wellhead bore 73 surrounding mandrel 27 is now isolated from fluid in the interior of tubing 77 and mandrel 27. The upper end of piston 31 will be below valve ball 47 as shown in FIG. 2A.

The operator then closes ball valve 45 and port valves 63, 65. The operator then opens bleedoff valve 61, bleeding off the pressure in the interior of housing upper section 13. The operator then opens wing valve 79 to bleed-off wellhead pressure surrounding mandrel 27 in bore 73. The pressure differential between the interior of mandrel 27 and bore 73 further energizes packoff 37 and assures that the seal is working. The operator removes upper section 13 by unscrewing it from valve body 19. Adapter 41 is unscrewed from upper section 13 and secured to threads 17 on the upper end of valve body 19. The service company connects a line from its pumps (not shown) to adapter 41.

Valve 45 is opened and the treating is started. As proppant-laden fluid is being pumped, high velocity is reached inside nozzle 39. Annular recesses 83 reduce velocity by creating turbulence, minimizing erosion of the downstream tubing 77. The turbulent flow generated by the discontinuities of recesses 83 disrupts the erosive effects of proppants in the pumped slurry. Recesses 83 disrupt the direction of the velocity vector as the pumped fluid passes through a change in diameter between nozzle 39 and production tubing 77. With this design, solids in the slurry have a tendency to concentrate at the inner portion of the exit flow profile, reducing wear on production tubing 77.

After the treatment is completed, valve 45 (FIG. 2A) is closed and the treating line pressure bled. Tubing head pressure will remain within housing lower section 23. Adapter 41 is removed and replaced with housing upper section 13 as shown in FIG. 1A–1C. A plug valve will be mounted to adapter 41, and adapter 41 will be secured to the upper end of housing upper section 13. The plug valve and wellhead wing valve 79 are closed (FIG. 1C). Ports 53, 55 and 59 are opened by opening valves 65 and 63. This pressurizes housing upper section 13 to the same level as housing lower section 23. Ball valve 45 is then opened, having no differential pressure across it. In the lower position, piston 31 will be located above injection port 66. Hydraulic pressure is now applied from pressure source through port 66 to a pressure higher than the existing wellhead pressure which is contained within housing upper and lower sections 13, 23. This pressure acts on the lower side of piston 31 and moves mandrel 27 upward back to its position shown in FIGS. 1A–1C. Nozzle 39 will now be located above master valve 75 (FIG. 1C), allowing it to be closed. Pressure in mandrel passage 29 and in housing passage 25 is then bled off through port 53 and valve 61. Tool 11 may then be disconnected from wellhead 71 and removed.

The invention has significant advantages. The isolation tool isolates the bore of a wellhead from treating fluid. By being able to remove the upper section, the overall height is reduced to facilitate connection of the treating line. The turbulent enhancing grooves in the nozzle reduce erosion.

While the invention has been shown in only one of its forms, it should be apart to those skilled in the art that it is not so limited, but is susceptible to various changes without departing from the scope of invention.

I claim:

1. A wellhead isolation tool for isolating a bore of a wellhead from a treating fluid, comprising in combination:

a housing having an upper section and a lower section, the lower section having a threaded upper end which connects to a threaded lower end of the upper section, the lower section having a lower end adapted to be connected to an upper end of a wellhead, the upper and lower sections of the housing having a passage which is adapted to be in alignment with the bore of the wellhead along a longitudinal axis of the housing when the housing is installed on the wellhead;

a valve connected into the lower section of the housing for selectively opening and closing the passage;

a tubular mandrel slidably carried in the housing, the mandrel being movable from an upper position in which a lower end of the mandrel is spaced above the lower end of the housing, to a lower position in which the lower end of the mandrel protrudes below the lower end of the housing for passing into the bore of the wellhead;

the mandrel having an upper end which is below the valve while the mandrel is in the lower position, enabling the valve to be closed and the upper section of the housing removed; and the threaded connection of the upper end of the lower section of the housing adapted to be connected to a line for pumping treating fluid through the mandrel and into the well.

2. The isolation tool according to claim 1, further comprising a piston mounted to the upper end of the mandrel for moving the mandrel between the upper and lower positions by application of fluid pressure.

3. The isolation tool according to claim 1, further comprising:

an annular piston mounted to the mandrel in sliding engagement with the housing passage;

a seal stationarily mounted in the passage at a lower end of the housing in sliding engagement with the mandrel, defining an annular chamber between the piston and the seal;

a port for introducing hydraulic fluid pressure to the annular chamber to act against the piston in an upward direction, urging the piston upward relative to the housing; and wherein the mandrel has an interior which is adapted to be exposed to wellhead pressure while the mandrel is in the upper position, which will act on the piston in a downward direction, allowing the mandrel to be moved downward by lowering the hydraulic fluid pressure relative to the wellhead pressure.

4. The isolation tool according to claim 1, further comprising a bleed off port extending through the housing above the valve for bleeding off any pressure within the upper section of the housing after the valve is closed prior to removing the upper section from the lower section.

5. The isolation tool according to claim 1, further comprising a pair of ports connected to each other and extending through the housing above and below the valve, to equalize pressure across the valve before opening.

6. The isolation tool according to claim 1, further comprising a nozzle located at the lower end of the mandrel, the nozzle having a passage containing a plurality of depressions for creating turbulent flow of the treating fluid.

7. The isolation tool according to claim 1, further comprising a nozzle located at the lower end of the mandrel, the nozzle having a passage containing a plurality of annular depressions for creating turbulent flow of the treating fluid.

8. A wellhead isolation tool for isolating a bore of a wellhead from a treating fluid being injected, the wellhead supporting a string of tubing extending into the well, the tool comprising in combination:

a housing having an upper section and a lower section, the lower section having a threaded upper end which connects to a threaded lower end of the upper section, the lower section having a lower end adapted to be connected to an upper end of a wellhead, the upper and lower sections of the housing having a passage which is adapted to be in alignment with the bore of the wellhead when the housing is installed on the wellhead;

a valve connected into the lower section of the housing at the upper end of the lower section for selectively closing the passage;

a tubular mandrel slidably carried in the housing;

an annular piston mounted to an upper end of the mandrel in sliding engagement with the housing passage;

a seal stationarily mounted in the passage at a lower end of the housing in sliding engagement with the mandrel, defining an annular chamber between the piston and the seal;

a port for introducing hydraulic fluid pressure to the annular space to act against the piston in an upward direction to move the piston upward relative to the housing; and wherein the mandrel has an interior which is adapted to be exposed to wellhead pressure while the mandrel is in the upper position, which will act on the piston in a downward direction, allowing the mandrel to be moved downward by lowering the hydraulic fluid pressure relative to the wellhead pressure;

the upper end of the mandrel being below the valve and the lower end of the mandrel adapted to sealingly engage the tubing while the mandrel is in the lower position, enabling the valve to be closed and the upper section of the housing removed; and the threaded connection of the upper end of the lower section adapted to be connected to a line for pumping treating fluid through the mandrel and into the well.

9. The isolation tool according to claim 8, further comprising a bleed off port extending through the housing above the valve for bleeding off any pressure within the upper section of the housing after the valve is closed prior to removing the upper section from the lower section.

10. The isolation tool according to claim 8, further comprising a pair of ports connected to each other and extending through the housing above and below the valve to selectively equalize pressure across the valve before opening.

11. The isolation tool according to claim 8, further comprising a nozzle located at the lower end of the mandrel, the nozzle having a packoff for sealing into the tubing, the nozzle having a passage containing a plurality of depressions for creating turbulent flow of the treating fluid.

12. The isolation tool according to claim 8, further comprising a nozzle located at the lower end of the mandrel, the nozzle having a passage containing a plurality of annular depressions for creating turbulent flow of the treating fluid.

13. A wellhead isolation tool for isolating a bore of a wellhead from a treating fluid, comprising in combination:

a housing adapted to be connected to an upper end of a wellhead;

a tubular mandrel slidably carried in the housing, the mandrel being movable from an upper position wherein a lower end of the mandrel is spaced above the lower end of the housing, to a lower position in which the lower end of the mandrel protrudes below the lower end of the housing for passing into the bore of the wellhead; and a nozzle located at the lower end of the mandrel, the nozzle having a passage containing a plurality of depressions for creating turbulent flow of the treating fluid.

14. The tool according to claim 13, wherein the depressions are annular recesses.

15. A method for isolating a bore of a wellhead from injection of a treating fluid, comprising in combination:

(a) providing a housing having upper and lower sections which are releasable from each other and a valve in the lower section of the housing for opening and closing a passage extending through the housing;

(c) placing a tubular mandrel in the housing and mounting the housing to a wellhead; then (d) with the valve open, moving the mandrel to a lower position in which a lower end of the mandrel passes into the bore of the wellhead and an upper end of the mandrel is in the passage below the valve; then (e) closing the valve and removing the upper section of the housing from the lower section; then (f) connecting a line to the lower section of the housing and pumping treating fluid through the line into the mandrel and through the mandrel into the well.

16. The method according to claim 15, wherein step (d) comprises:

providing an annular piston on the upper end the mandrel;

mounting a seal stationarily mounted in the passage at a lower end of the housing in sliding engagement with the mandrel, providing an annular chamber between the piston and the seal;

introducing hydraulic fluid pressure to the annular chamber to act against the piston in an upward direction;

exposing wellhead pressure to an upper end of the piston to act on the piston in a downward direction; then lowering the hydraulic fluid pressure to a level that creates a net downward force on the mandrel, causing the mandrel to move to the lower position.

17. The method according to claim 15, further comprising bleeding off any pressure within the upper section of the housing after the valve is closed prior to removing the upper section from the lower section in step (e).

18. The method according to claim 15, further comprising:

after step (f), removing the treating line and reconnecting the upper section of the housing to the lower section of the housing, with the valve still closed; then equalizing pressure differential between the upper and lower sections of the housing; then opening the valve and moving the mandrel back to the upper position; then removing any pressure in the upper and lower sections of the housing and removing the upper and lower sections of the housing from the wellhead.

* * * * *